United States Patent [19]

DiSabatino et al.

[11] 4,121,822

[45] Oct. 24, 1978

[54] EXERCISE AND GAME APPARATUS

[76] Inventors: Bernard A. DiSabatino; Joan K. DiSabatino; Bernard A. DiSabatino, Jr.; Craig D. DiSabatino, all of 506 Bayard Ave., Rehoboth Beach, Del. 19971

[21] Appl. No.: 804,402

[22] Filed: Jun. 7, 1977

[51] Int. Cl.[2] ..... A63B 69/26

[52] U.S. Cl. ..... 272/78; 2/310; 182/3; 272/DIG. 4; 273/DIG. 19

[58] Field of Search ..... 272/78, 76, 77, 119, 272/139, 143; 273/DIG. 17, DIG. 18, DIG. 19, 58 C; 2/305, 310, 312, 319, 338, 340, 1; 182/3, 4

[56] References Cited

U.S. PATENT DOCUMENTS

| | | | |
|---|---|---|---|
| 650,656 | 5/1900 | Raabe | 272/139 |
| 866,495 | 9/1907 | Marks | 272/139 |
| 1,506,631 | 8/1924 | Grover | 272/139 |
| 1,618,273 | 2/1927 | Davidson | 272/139 |
| 2,564,564 | 8/1951 | Cookman | 2/310 X |
| 3,397,887 | 8/1968 | Caplan | 273/58 C |
| 3,599,238 | 8/1971 | Matthews | 2/1 |
| 4,021,035 | 5/1977 | O'Hara | 272/78 |

FOREIGN PATENT DOCUMENTS

| | | | |
|---|---|---|---|
| 2,352,475 | 10/1973 | Fed. Rep. of Germany | 273/DIG. 19 |
| 728,643 | 4/1932 | France | 272/78 |
| 774,181 | 9/1934 | France | 272/78 |
| 245,274 | 1/1926 | United Kingdom | 272/139 |

OTHER PUBLICATIONS

Atlas Safety Equipment Company, Inc., Catalog 65, Brooklyn, N. Y.

*Primary Examiner*—Richard C. Pinkham
*Assistant Examiner*—Arnold W. Kramer

[57] ABSTRACT

A belt, which is adapted to be carried about a portion of the trunk of the user, is mounted around the waist, in holster style, and over a shoulder and under an opposite arm. The over the shoulder portion having a plurality of loops to which a resilient ball is selectively connected by a line to adjustably extend from the belt downward either to the hip, knee, or foot area of the user.

4 Claims, 4 Drawing Figures

EXERCISE AND GAME APPARATUS

BACKGROUND OF THE INVENTION

This invention relates to toys and games, and more particularly to game apparatus for promoting fitness and physical coordination.

There has recently been heard an extensive hue and cry concerning the degrading physical fitness level of the American populace. Spectator sports are ever more popular, but overweight and coronary problems are statistically on the increase. Nearly everyone realizes that these problems are minimized by the taking of vigorous physical exercise on a regular basis. Many people, however, find calisthenics, jogging, or other conventional exercises to be burdensome and boring; notwithstanding the best of intentions, few such exercise programs are sustained for any considerable rate or time.

It is an object of the present invention to provide exercise apparatus which provides an amusing and entertaining format, whereby vigorous activity may be undertaken absent the drudgery generally associated with calisthenics or the like.

Although many sports and games involve sufficiently vigorous physical activity to have salutary effects on the health of the players, most require from one to several partners for participation in the game. It is an object of the present invention to provide apparatus which may be utilized in an entertaining fashion by a single person, without requiring one or more partners to play.

It is yet another object of the present invention to provide exercise and game apparatus which promotes the coordination, sense of rhythm, and timing of the participant, in an enjoyable format.

It is a still further object of the present invention to provide exercise and game apparatus which is neither physically cumbersome or unduly expensive, whereby children of all ages may be induced successfully to participate.

SUMMARY OF THE INVENTION

The present invention involves utilization of a ball, affixed by a line to the region of the upper torso of the user, and extending downwardly toward the leg and hip area. The user then bumps the ball outwardly through contact, as appropriate, at the lower legs, knees, or hips, and thereafter maintains ball motion by controlling the backward pendulum swing for each next successive engagement. Once the rhythm is established, the user may successively engage the ball with the same leg, or alternate legs, and the like.

In an illustrative embodiment, the user wears a belt around at least a portion of his upper torso, such as over one shoulder, diagonally across the trunk, and beneath the opposite arm. A flexible ball is tied to one end of a line, the other end of which is tied to the belt member. The length of the line determines whether the user will bump the ball against his hips, knee area, or foot area.

DETAILED DESCRIPTION

Figure 1A:
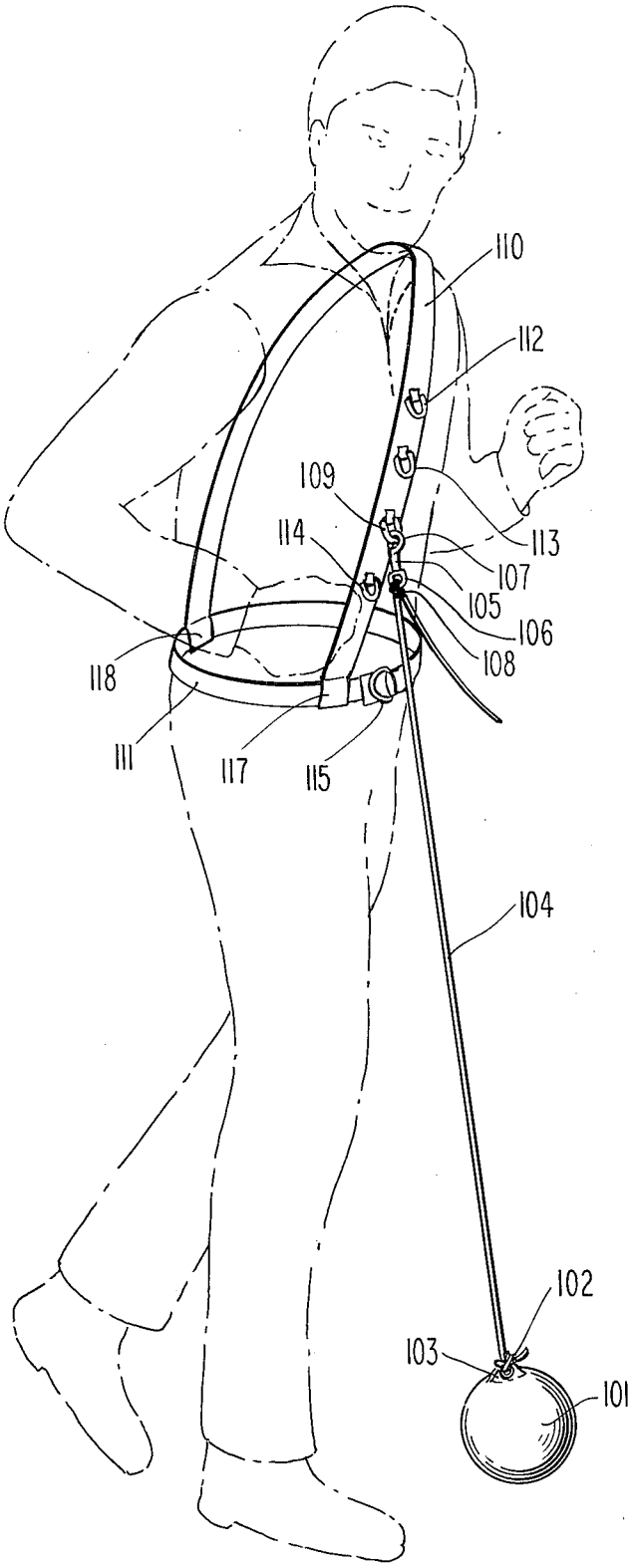
FIG. 1*a* shows a first illustrative embodiment of the present invention.
Figure 1B:
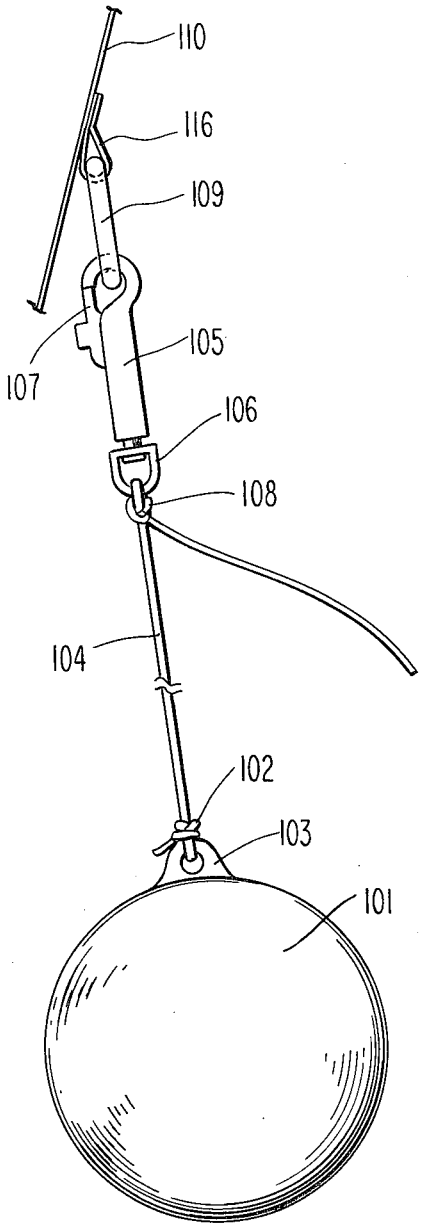
FIG. 1*b* shows a detail view of portions of the same.

Referring first to FIGS. 1*a* and 1*b*, there is shown an illustrative embodiment of the present invention wherein a belt member is utilized which is configured similarly to the "safety patrol" belts in rather common utilization. In FIGS. 1*a* and 1*b*, a ball 101 is connected to a line 104 by means of a knot 102 to an annular projection 103 from the ball 101. The other end of the line 104 is knotted at 108 to the pivotable clevis member 106 of a shackle 105. In turn, the upper portion of shackle 105 is closed by a sprung latch 107 to a mount 109 and 116 of a belt member 110. As shown in FIG. 1*b*, the mount comprises a closed fabric loop 116, stitched to the belt 110, and a U-shaped member which is carried by the loop 116.

As shown in FIG. 1*a*, the belt member involves a lower portion 111, generally encircling the waist of the user, and a second portion 110 extending generally diagonally across the trunk of the user, up and over the shoulder. The lower portion 111 is appropriately cinched or buckled at 115, to conform to the waistline of the user. The upper portion 110 is connected at points 117 and 118 to the lower portion, generally on the side of the body opposite the shoulder over which portion 110 drapes. It will be appreciated that the connection points 117 and 118 may be rigid (e.g., sewn), or may involve loops over lower portion 111 and slidable therealong. Upper portion 110 carries a plurality of mounts 112, 113, and 114, similar to mounts 109 and 116 previously discussed.

It will be apparent that the embodiment of FIGS. 1*a* and 1*b* involves adjustment facility in several fashions, thereby not only being adaptable to use in conjunction with various parts of the body (i.e., hips, knees, or feet), but furthermore adaptable to utilization by persons young or old, of widely variable body size and configuration. First, the various connectors 112, 113, 114, and 116 allow for connection of the shackle 105 at various heights, and furthermore the line 104 may be adjusted in the length between clevis 106 and ball 101. Similarly, further adjustment facility may be provided, as is known in the art, for variation of the length of upper member 110 of the belt.

Figure 2:
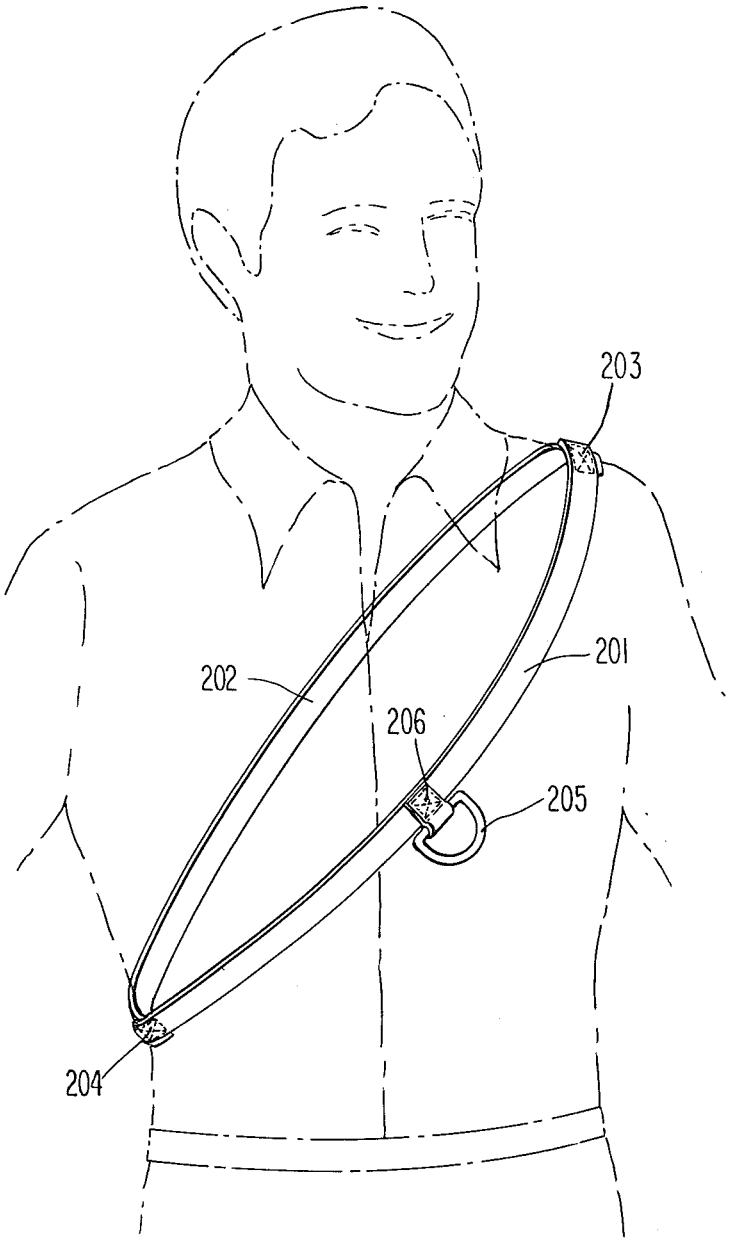
FIG. 2 shows an alternative illustrative embodiment of the present invention.

FIG. 2 shows an alternative embodiment, and specifically a different configuration of a belt means, to which a ball and line which may be attached such as shown in FIGS. 1*a* and 1*b*. In the FIG. 2 embodiment, respective front and back strap portions 201 and 202 are stitched together at their associated ends 203 and 204, thereby to form a holster type belt. In order to adapt to the configuration of the body, the seams 203 and 204 cause the straps 201 and 202 to address one another at approximately the perpendicular to one another, such that when the belt is worn as shown in FIG. 2, it will smoothly follow the contour of the body. Centrally located on one of the straps 201 is a mount for the ball and line, advantageously a fabric loop 206 and U-shaped clip 205 similar to those employed in the FIG. 1*a* embodiment. It will be understood that plural similar mounts may be spaced at various portions along the straps 201 and/or 202. Further, the holster type belt of FIG. 2 may be continuous such as shown, or may also employ cinch or belt members to provide adjustment to the shape of the body of the user.

Figure 3:
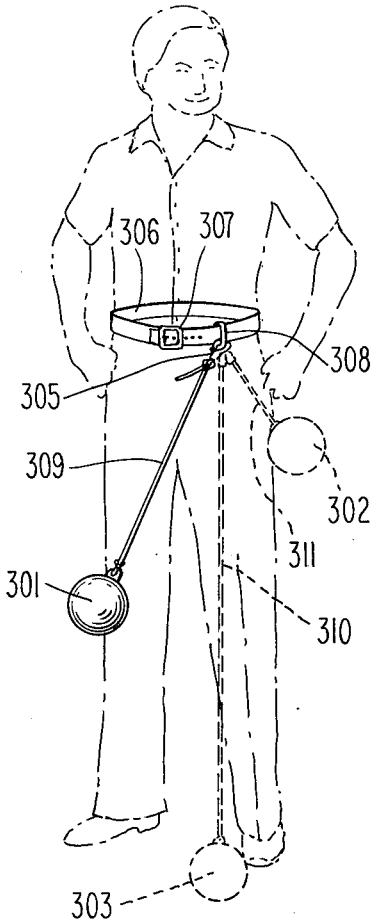
FIG. 3 shows yet another illustrative embodiment, further illustrating various modes of utilization.

FIG. 3 shows still another embodiment, employing a belt 306 which buckles at 307 around the trunk of the body, advantageously about the waist as shown. Similarly, the belt 306 may be positioned about the chest under the armpits, or the like. Belt 306 carries a loop 308 thereabout, which is slidable to any position on the belt. The line 309 is attached by a shackle 305 (similar to shackle 105 of FIG. 1) to the loop 308.

The embodiment of FIG. 3 illustrates utilization of the device in alternate modes, that is, being bumped against the hip (i.e., ball 302 and line 311 shown in phantom), against the feet (i.e., ball 303 and line 310 also shown in phantom), or against the knee (i.e., ball 301 and line 309).

In accordance with the principles of the present invention, it is desired that the ball such as 101 or 301 be relatively light-weight and resilient, having sufficient weight to maintain pendulum performance, but being of sufficiently light weight and flexibility (i.e., bounce) to avoid injury or discomfort to the user. The rope such as 104 or 309 is advantageously embodied as stranded nylon cord, or similar strong, light-weight, or flexible ropes. The rope may be attached to the ball utilizing an annular extension from the ball as shown, or may be attached by any other conventional method. The belts such as 110, 111, 201, 202, and 306, are embodied as leather, canvas, synthetic material webbing, or similar readily available materials.

In use, the ball is kept in motion in rhythmic fashion by successive bumps and manipulations by the associated portion of the lower body of the user, with the rhythm being suitably maintained by motion of the upper body. Not shown is a similar useage wherein the ball is affixed to the associated belt member behind the user.

It is to be understood that the foregoing sets forth illustrative and preferred embodiments of the present invention, but that numerous alternatives will occur to those of ordinary skill in the art without departure from the spirit or scope thereof. For example, a large variety of methods may be employed for fastening the line to the ball, and also to the belt, ranging from simple knots to elaborate configurations. Likewise, an alternative configuration may be employed for the knot 102 and the annular projection 103. For example, the line 104 may directly penetrate ball 101, and be fastened thereto by glue or by a knot or clip within ball 101. Similarly, the projection 103 may be solid rather than annular as shown, and line 104 may be glued to or within such projection, or constitute an integral extension thereof.

A similar alternative involves utilization of an integral line and belt member. Thus, although "line" and "belt member" are used as distinct terms herein, it is to be understood that a single extended cord may constitute the line 104 and extend around the portions of the trunk of the body of the user to fulfill the functions attributed to the "belt member", (e.g., 110 in FIG. 1*a*, 201 in FIG. 2, or 306 in FIG. 3).

We claim:

1. Exercise and game apparatus comprising:

a belt having a first portion, adjustable to be carried about the waist of the user, and a second portion connected to said first portion at respective front and back locations on one side of the body of the user, said second portion extending generally diagonally upwardly between said front and back locations and adapted to be worn diagonally across the trunk of the user and over the shoulder opposite said one side, said first and second portions each having a flat web cross section;

a plurality of loop members secured each at a different location along said belt second portion, each being at different heights when said belt's second portion is worn over the shoulder of the user;

a resilient ball; and a line of predetermined length, connected at one end to said ball and at an opposite end to one of said plurality of loop members.

2. Apparatus of claim 1 also including a pivotal clevis shackle, said shackle being connected to said opposite end of said line by said pivotal clevis portion thereof.

3. Apparatus of claim 1 wherein said plurality of loop members each includes a fabric loop secured to said belt second portion and a U-shaped clip attached thereto, wherein said opposite end of said line is connected to one of said U-shaped clips.

4. Apparatus of claim 3 also including a pivotal shackle, said shackle having a snap ring portion and pivotal clevis portion and being attached between said one U-shaped clip and said line opposite end.

* * * * *